US007014508B2

(12) United States Patent
Tsai

(10) Patent No.: US 7,014,508 B2
(45) Date of Patent: Mar. 21, 2006

(54) MULTI-CARD CONNECTOR ASSEMBLY WITH A MOVABLE MULTI-CARD CONNECTOR

(76) Inventor: Chou Hsuan Tsai, 15F,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/029,112

(22) Filed: Dec. 31, 2004

(65) Prior Publication Data

US 2005/0148244 A1 Jul. 7, 2005

(30) Foreign Application Priority Data

Jan. 7, 2004 (TW) ..... 93100391 A

(51) Int. Cl.
*H01R 24/00* (2006.01)

(52) U.S. Cl. ..... 439/630; 439/259

(58) Field of Classification Search ..... 439/629–632, 439/259–267, 59, 62, 76, 77, 67, 108, 74, 439/541.5, 492–499, 76.1, 159; 361/737, 361/728, 752, 796

See application file for complete search history.

(56) References Cited

U.S. PATENT DOCUMENTS

| | | | | |
|---|---|---|---|---|
| 5,433,632 | A * | 7/1995 | Cherney et al. | 439/495 |
| 5,548,484 | A * | 8/1996 | Kantner | 361/737 |
| 5,947,764 | A * | 9/1999 | Pan et al. | 439/492 |
| 6,036,519 | A * | 3/2000 | Lopata et al. | 439/260 |
| 6,171,122 | B1 * | 1/2001 | Futatsugi et al. | 439/159 |
| 6,478,616 | B1 * | 11/2002 | Yeh | 439/541.5 |
| 6,551,131 | B1 * | 4/2003 | Kuo | 439/541.5 |

* cited by examiner

*Primary Examiner*—P. Austin Bradley
*Assistant Examiner*—Edwin A. Leon
(74) *Attorney, Agent, or Firm*—Pro-Techtor Int'l Services

(57) ABSTRACT

In a multi-card connector assembly with a movable multi-card connector, a mounting seat has a sliding region and a mounting portion. A multi-card connector is disposed in the sliding region. The multi-card connector can be moved only back and forth in the sliding region. The multi-card connector includes a common seat having a plurality of slots into which different electrical cards may be individually inserted, a plurality of terminals disposed on the common seat, and a flexible circuit connection interface electrically connected to the terminals. The flexible circuit connection interface may be connected to an external interface. An elastic member has one end fixed to the mounting seat and the other end fixed to the multi-card connector. A positioning device is disposed on the mounting seat and the multi-card connector and for positioning the multi-card connector, which slides in the sliding region, at at least one positioning point.

13 Claims, 13 Drawing Sheets

MULTI-CARD CONNECTOR ASSEMBLY WITH A MOVABLE MULTI-CARD CONNECTOR

BACKGROUND OF THE INVENTION

1. Field of the Invention

The invention relates to a multi-card connector assembly, and more particularly to a multi-card connector assembly with a movable multi-card connector.

2. Description of the Related Art

Electrical cards for computers include multimedia storage cards or memory cards. The available memory cards, such as the Secure Digital Card (SDC), MultiMedia Card (MMC), Smart Media Card (SMC), Memory Stick Card (MSC), XD-picture card (XDC), and the like, in the market have various specifications. Because the positions of connection points of the memory cards with different specifications are not the same, the electrical connectors to be connected to the memory cards with different specifications are not the same.

In order to facilitate the usage, the manufacturers try to integrate different electrical connectors into an electrical connector assembly suitable for various memory cards with various specifications. Thus, the user can conveniently use various memory cards in conjunction with the connector assembly.

The used electrical card has to be inserted into and removed from the connector. As shown in FIG. 1, a card may be inserted into and removed from an electrical card connector 10. The connector 10 is electrically connected to a mainboard of a corresponding electrical device 15, and has an insert port that is substantially flush with a casing 16 of the electrical device 15. When an electrical card 18 is inserted, a card guiding in/out device (not shown) disposed in the electrical card connector 10 may be used to position the electrical card 18, which is not exposed. As shown in FIG. 2, when the card is to be taken out, the user may slightly press the electrical card 18 such that the electrical card 18 can be ejected.

Because the above-mentioned electrical card connector has to be connected and fixed to the mainboard, the card guiding in/out structure is disposed in the body of the electrical card connector so as to guide the electrical card in and out. However, the body of the electrical card connector is stationary, and thus has the following drawbacks.

1. The inserted electrical card is electrically connected to the terminals of the connector, so the electrical card is positioned and rejected through a card guiding in/out structure, and the contact points of the terminals with the inserted and rejected electrical card are rubbed many times. Thus, the lifetime of the electrical connector is shortened and the number of insertions and rejections is reduced.

2. Because the card guiding in/out structure is disposed in the body of the electrical card connector and different electrical cards have different widths and thicknesses, the structure is difficult to be used in conjunction with the multi-card connector. Thus, only one card guiding in/out structure cannot achieve the card guiding in/out operations of different electrical cards. It is not easy to dispose one card guiding in/out structure within the space of the body of the electrical card connector. It is more difficult to dispose two or more card guiding in/out structures in conjunction with different electrical cards, so the current multi-card connectors have no card guiding in/out structure.

3. Since the multi-card connector does not have the card guiding in/out structure, the inserted electrical card is partially exposed out of the casing after being positioned such that the user's hand can remove the card. However, the exposed card causes the poor product feature or tends to cause the card to be damaged. Furthermore, the exposed lengths of the different electrical cards that are inserted are not the same, which is also a drawback in usage.

SUMMARY OF THE INVENTION

It is therefore an object of the invention to provide a multi-card connector assembly with a movable multi-card connector, wherein the assembly can perform the card guiding in/out operations for different electrical cards that have different dimensions and the inserted cards are free from being exposed out of the casing.

Another object of the invention is to provide a multi-card connector assembly with a movable multi-card connector in order to lengthen the lifetime of the electrical connector assembly and increase the number of inserting and ejecting the electrical cards.

Still another object of the invention is to provide a multi-card connector assembly with a movable multi-card connector, wherein the assembly has a plurality of strokes for guiding the cards with different lengths in/out.

To achieve the above-identified objects, the invention provides a multi-card connector assembly includes a mounting seat, a multi-card connector, an elastic member and a positioning device. The mounting seat has a sliding region and a mounting portion. The multi-card connector is disposed in the sliding region of the mounting seat. The multi-card connector can be moved only back and forth in the sliding region. The multi-card connector includes a common seat having a plurality of slots into which different electrical cards may be individually inserted, a plurality of terminals disposed on the common seat, and a flexible circuit connection interface electrically connected to the plurality of terminals. The flexible circuit connection interface may be connected to an external interface. The elastic member has one end fixed to the mounting seat and the other end fixed to the multi-card connector. The positioning device disposed on the mounting seat and the multi-card connector positions the multi-card connector, which slides in the sliding region, at at least one positioning point.

According to the above-mentioned structure, the multi-card connector slides back and forth in the sliding region of the mounting seat. The multi-card connector may be moved to a position of at least one stroke relative to the mounting seat according to the positioning device. Thus, the inserted electrical cards with different dimensions may achieve the card guiding in/out effect.

DETAILED DESCRIPTION OF THE INVENTION

Figure 1:
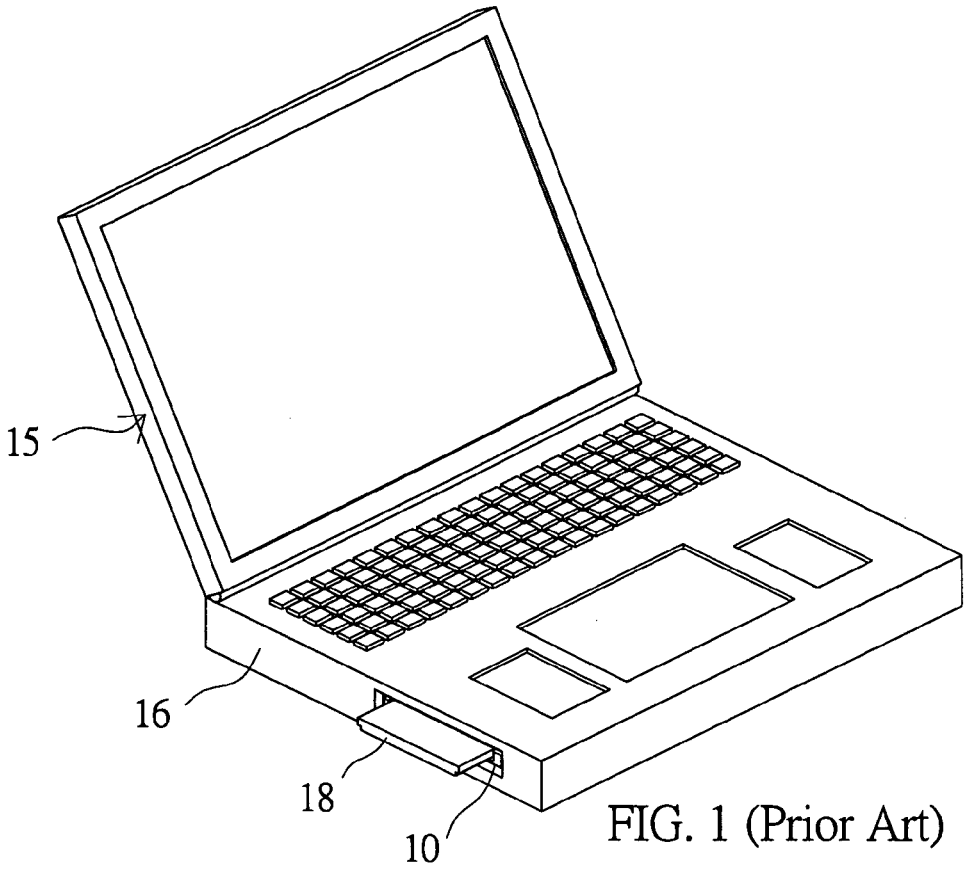
FIG. 1 (Prior Art)
FIG. 1 shows a first usage state of a conventional electrical card connector.
Figure 2:
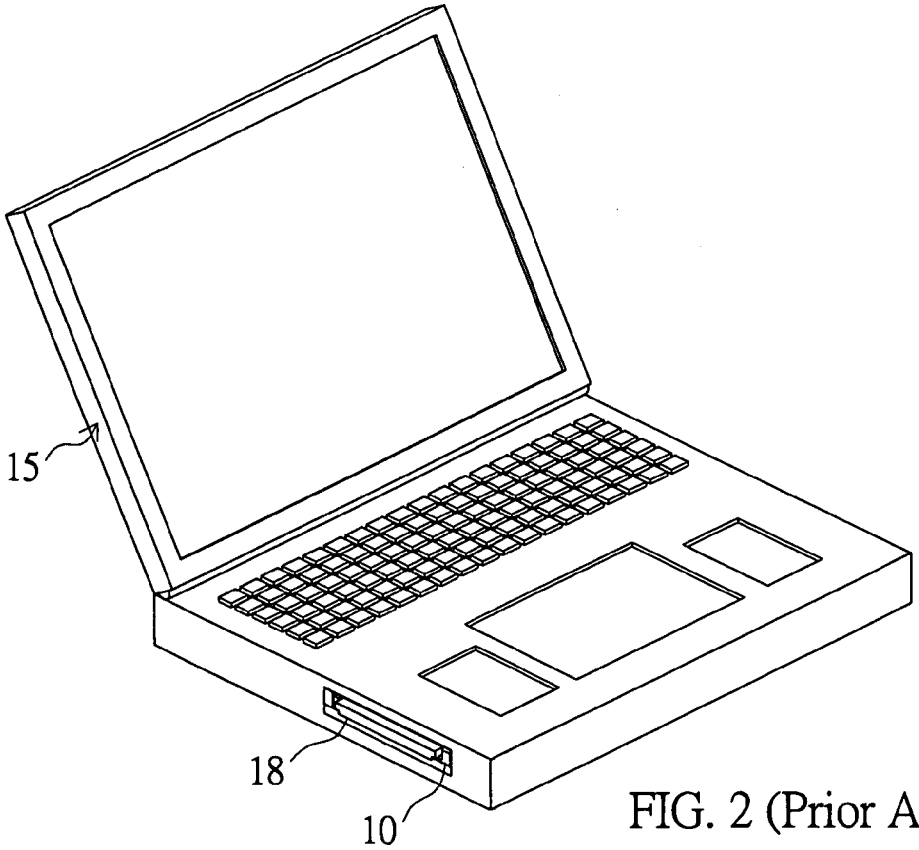
FIG. 2 (Prior Art)
FIG. 2 shows a second usage state of the conventional electrical card connector.
Figure 3:
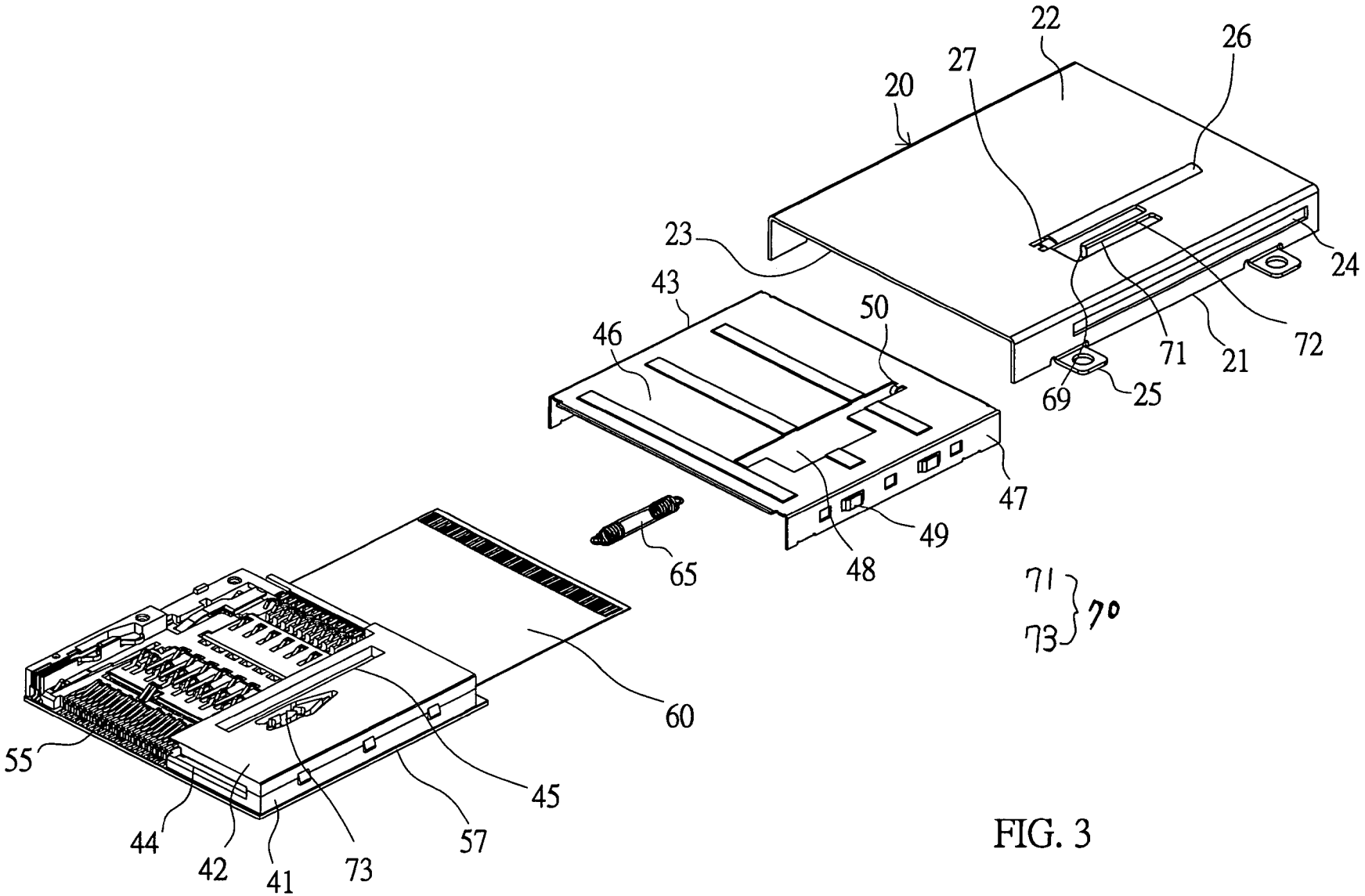
FIG. 3 is a pictorially exploded view showing a multi-card connector assembly according to a first embodiment of the invention.
Figure 4:
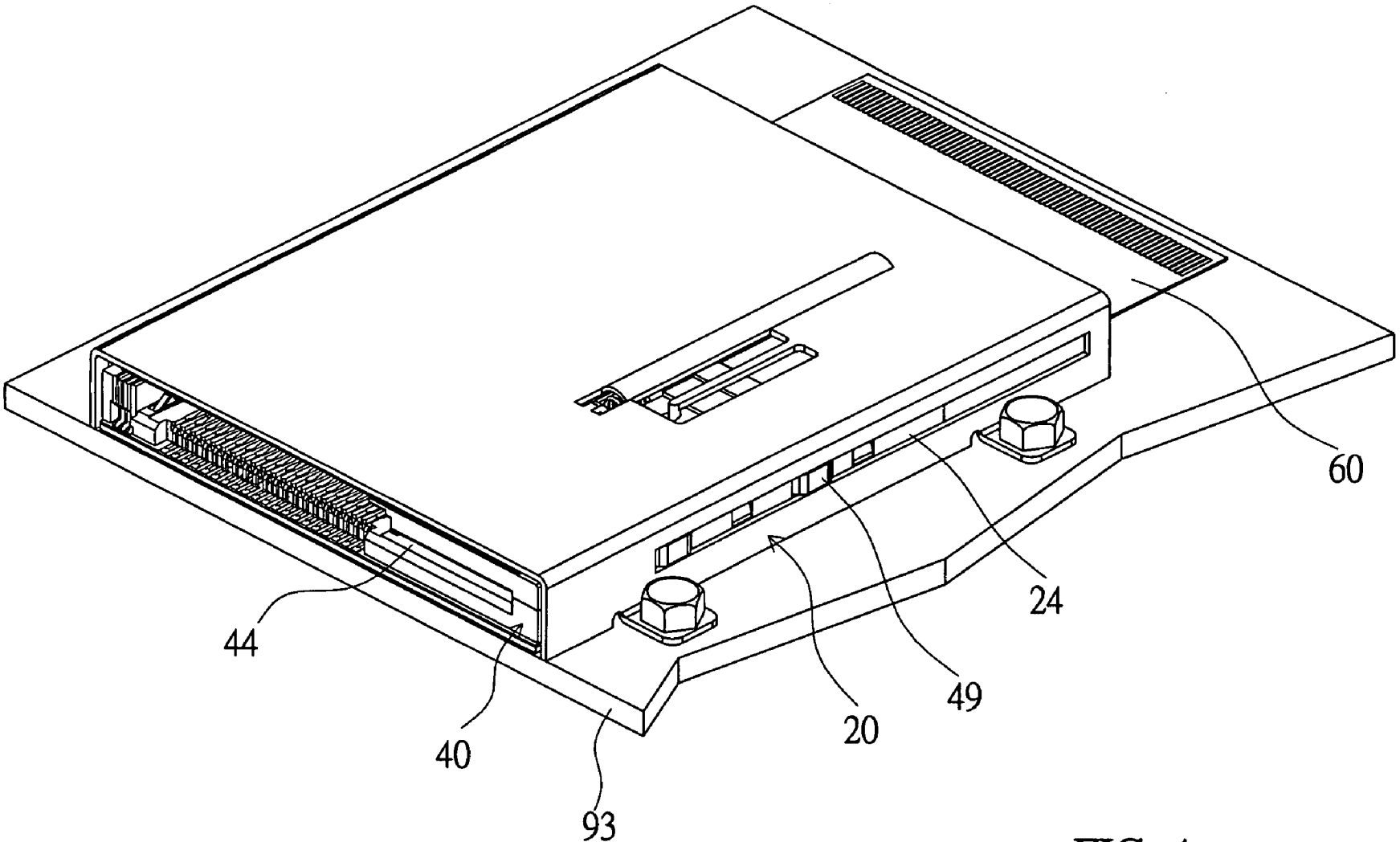
FIG. 4 is a pictorially assembled view showing the multi-card connector assembly according to the first embodiment of the invention.

Referring to FIGS. 3 and 4, the multi-card connector assembly of the invention includes a mounting seat 20, a multi-card connector 40, an elastic member 65, and a positioning device 70.

The mounting seat 20 is an inverse U-shaped metal base and has two side plates 21 and a top plate 22. A sliding region 23 is defined between the two side plates 21. Each side plate has a sliding slot 24 extending in the inserting direction of the card, and two mounting portions 25 at the lower edge. The mounting portion 25 has a positioning hole and is mounted to a casing 93 of an electrical product. The top plate 22 has a protrudent camber 26 and a hook 27.

The multi-card connector 40 disposed in the sliding region 23 of the mounting seat 20 can slide only back and forth in the sliding region 23. The multi-card connector 40 has a common seat, which is composed of a base 41, a middle board 42 and an upper cover 43 such that a plurality of slots 44 for individually receiving different electrical cards that are inserted is formed. The middle board 42 covers over the base 41 and is formed with a long slot 45 extending in the back and forth direction. The upper cover 43 is a metal base and has a top plate 46 and two side plates 47. The upper cover 43 covers over the top and two sides of the base 41 and the middle board 42. The top plate 46 may be formed with an opening 48 for exposing the long slot 45 of the middle board, and a hook 50 close to the tail end. Engagement blocks 49 to be engaged with the sliding slots 24 of the mounting seat 20 are formed at the side plates. The multi-card connector 40 also has a plurality of terminals 55 disposed on the base 41 of the common seat, a flexible printed circuit board 57 formed with traces to be electrically connected to the terminals 55, and a flexible circuit connection interface 60, which is a flexible printed circuit cable and integrally connected and electrically connected to the flexible printed circuit board 57. So, the flexible circuit connection interface 60 becomes the output terminals of the plurality of terminals 55 and may be flexibly connected to an external interface.

The elastic member 65 is a retractable spring having one end fixed to the hook 27 of the mounting seat 20, and the other end fixed to the hook 50 of the upper cover 43 of the multi-card connector 40.

Figure 5:
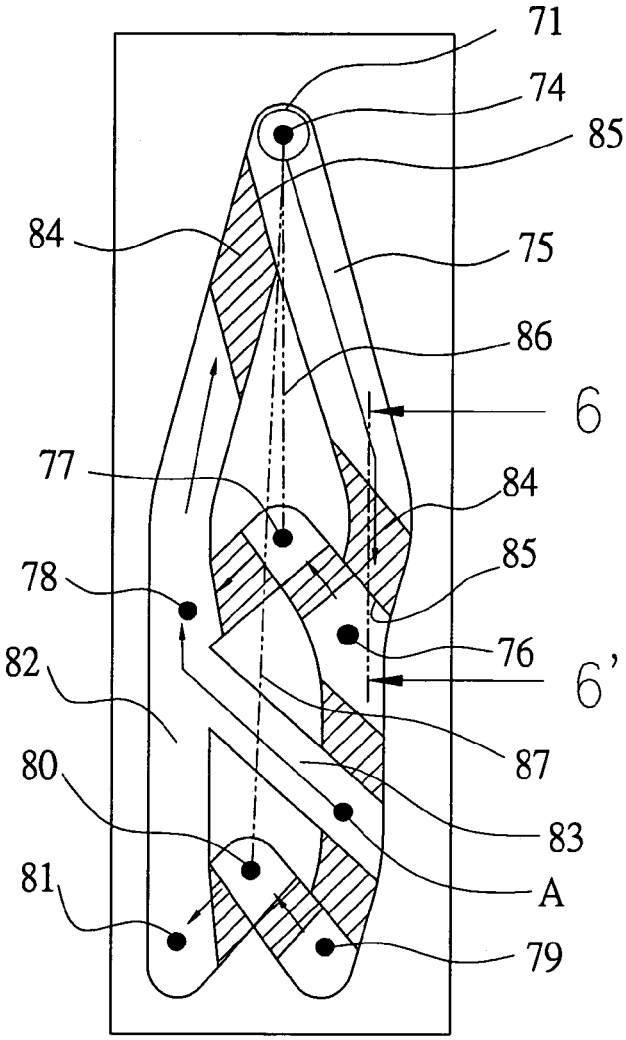
FIG. 5 is a schematic top view showing a positioning slot according to the first embodiment of the invention.
Figure 6:
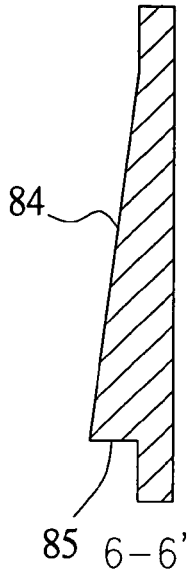
FIG. 6 is a cross-sectional view showing the positioning slot according to the first embodiment of the invention.
Figure 7:
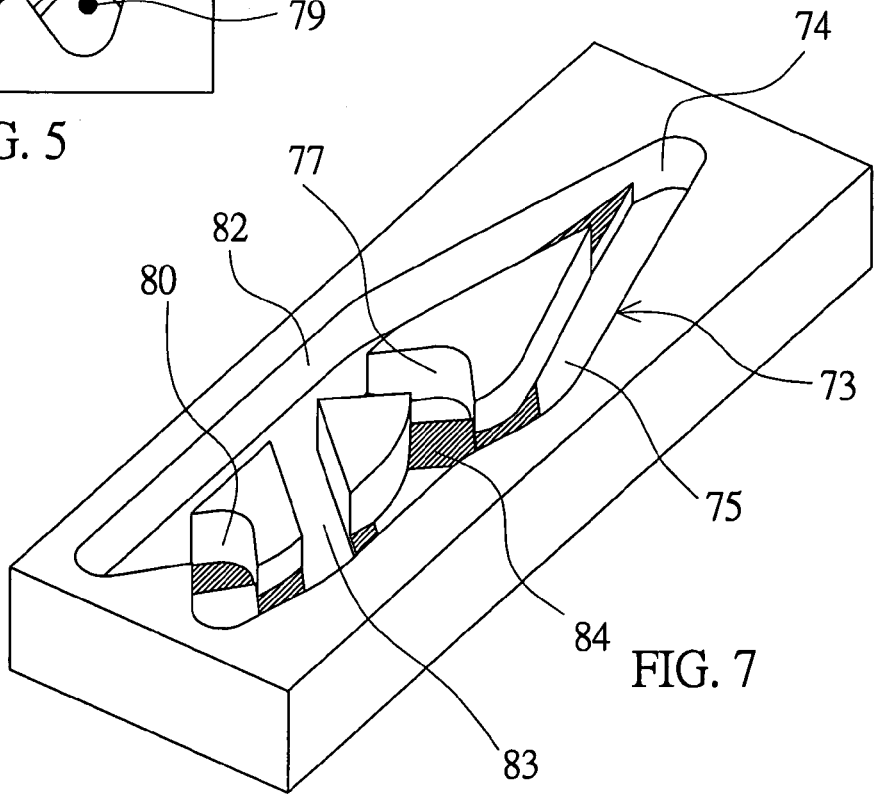
FIG. 7 is a pictorial view showing the positioning slot according to the first embodiment of the invention.

The positioning device 70 is disposed on the multi-card connector 40 of the mounting seat 20 such that the multi-card connector 40 can be positioned at at least one positioning point when it is sliding in the sliding region 23 of the mounting seat 20. The positioning device 70 includes a positioning guiding rod 71 and a positioning slot 73. The positioning guiding rod 71 is integrally formed with the top plate 22 of the mounting seat and has an elastic arm 72 and a post 69 formed by bending the tail end of the elastic arm downwards. The positioning slot 73 is disposed on the middle board 42 of the multi-card connector and is a one-way sliding passage. Referring also to FIGS. 5 to 7, the positioning slot 73 has a starting point 74, a first sliding passage 75, a first stroke point 76, a first positioning point 77, a first stroke card-out starting point 78, a second stroke point 79, a second positioning point 80, a second stroke card-out starting point 81, a second sliding passage 82, a guiding passage 83, a plurality of bevels 84 and engagement surfaces 85 (the hatched areas in FIGS. 5 and 7 represent the bevels 84).

The positioning slot 73 has two strokes of circulating directions. The first stroke circulation starts from the starting point 74 to the first sliding passage 75, the first stroke point 76, the first positioning point 77, the first stroke card-out starting point 78, the second sliding passage 82, and then to the starting point 74. The reciprocation length generated in the first stroke circulation is the straight line distance from the starting point 74 to the first positioning point 77 and is called as a first stroke 86. The second stroke circulation starts from the starting point 74 to the first sliding passage 75, the second stroke point 79, the second positioning point 80, the second stroke card-out starting point 81, the second sliding passage 82, and then to the starting point 74. The reciprocation length generated in the second stroke circulation is the straight line distance from the starting point 74 to the second positioning point 80, and is called as a second stroke 87. The bevels 84 and engagement surfaces 85 are disposed on the above-mentioned circulation paths. The engagement surface 85 is formed at an end of the path of the bevel 84. Thus, the positioning guiding rod 71 may circulate according to the above-mentioned strokes according to the bevel 84 and the engagement surface 85 when the positioning guiding rod 71 is relatively sliding in the positioning slot 73. In addition, the positioning guiding rod 71 may be positioned at the starting point 74, and the first and second positioning points 77 and 80 according to the elastic effect of the elastic member 65.

In addition, when the multi-card connector 40 originally operates in the second stroke but the connector 40 is not deeply pressed such that the positioning guiding rod 71 only reaches the point A but does not reach the second stroke point 79, the positioning slot 73 cannot position the positioning guiding rod 71, but can guide the rod 71 to the second sliding passage 82 and then back to the starting point 74 in the direction of the guiding passage 83. Thus, the rod 71 is free from entering the first positioning point 77, and the user can operate again. Hence, it is possible to prevent the rod from being positioned at an error position and thus to prevent the electrical card from being exposed due to the error operation.

According to the above-mentioned structure, the multi-card connector 40 has the engagement blocks 49 at two sides, and the engagement block 49 slides in the sliding slot 24 of the mounting seat. The multi-card connector 40 can be moved in two strokes relative to the mounting seat 20 according to the positioning device 70. Furthermore, because the multi-card connector 40 has the flexible circuit connection interface 60 to achieve the flexible electrical connection, the whole connector body can be moved, and the card guiding in/out effects can be achieved when different electrical cards with different dimensions are inserted.

Figure 8:
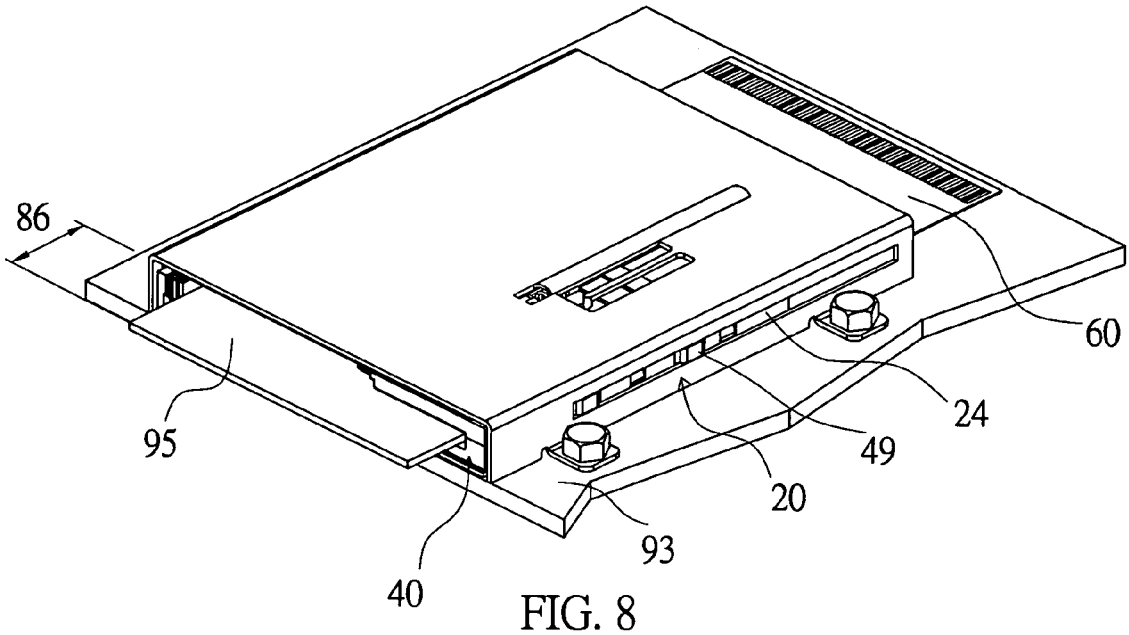
FIG. 8 shows a first usage state when an SMC is inserted into the multi-card connector assembly according to the first embodiment of the invention.
Figure 9:
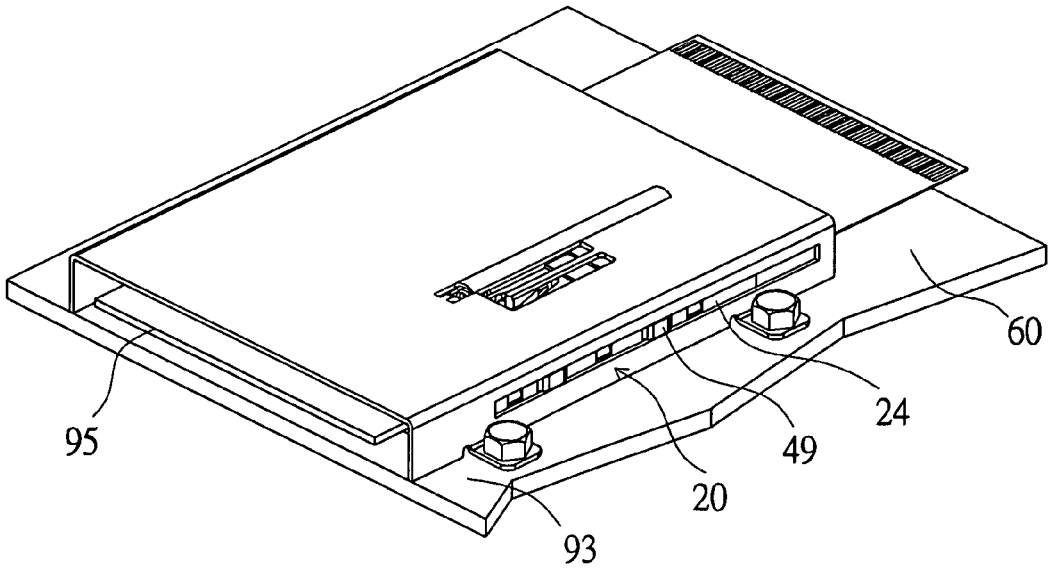
FIG. 9 shows a second usage state when the SMC is inserted into the multi-card connector assembly according to the first embodiment of the invention.

As shown in FIG. 8, the mounting seat 20 is mounted on the casing 93 of the electrical product. When an SMC 95 is inserted into the multi-card connector 40 for electrical connection, the length of the SMC exposed out of the casing 93 substantially equals the first stroke 86. As shown in FIG. 9, the SMC 95 may be pressed inwards. At this time, the SMC 95 and the multi-card connector 40 slide relative to the mounting seat 20. When an outer edge of the SMC 95 is flush with the casing 93, the multi-card connector 40 moves the front section of the first stroke circulation relative to the mounting seat. As shown in FIG. 5, when the positioning guiding rod 71 of the positioning device is positioned at the first stroke point 76, the elasticity of the elastic member 65 may cause the first positioning point 77 of the positioning slot 73 to lock the positioning guiding rod 71. At this time, the SMC 95 and the multi-card connector 40 are positioned at the position when the multi-card connector 40 slides the first stroke toward the inside of the mounting seat. When the card is to be taken out, the user may press the SMC 95 inwards, and the positioning guiding rod 71 is located at the first stroke card-out starting point 78. When the user lets his/her hand go, the positioning slot 73 slides relative to the positioning guiding rod 71 in the direction of the second sliding passage owing to the action of elasticity. Thus, the positioning guiding rod 71 returns to the starting point 74 again, as shown in FIG. 8. At this time, the multi-card connector 40 is ejected, and a length of the SMC 95 is exposed out of the casing 93 so that the SMC may be conveniently removed.

Figure 10:
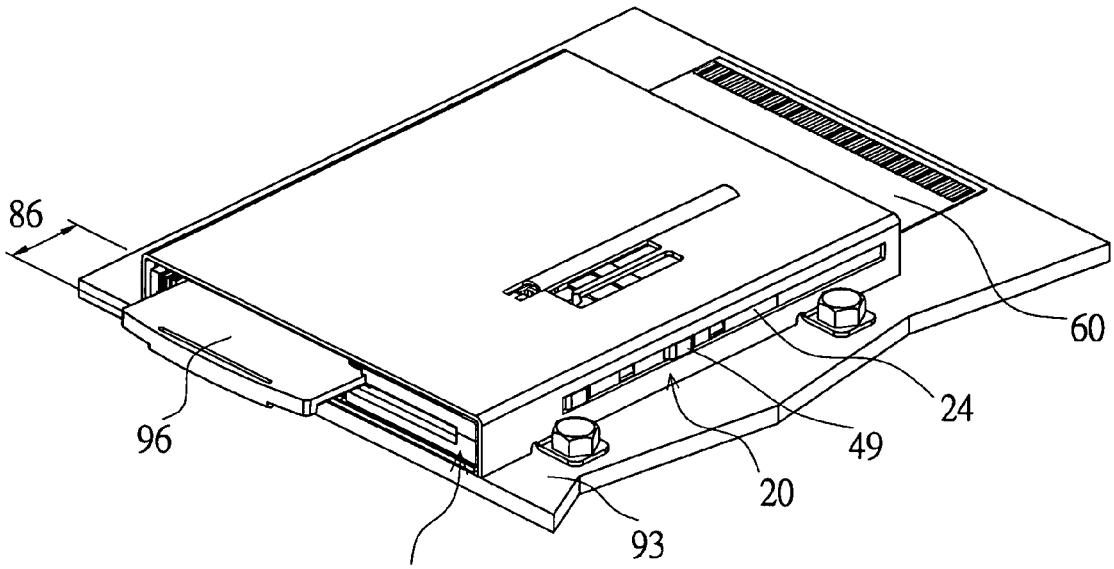
FIG. 10 shows a first usage state when an XDC is inserted into the multi-card connector assembly according to the first embodiment of the invention.
Figure 11:
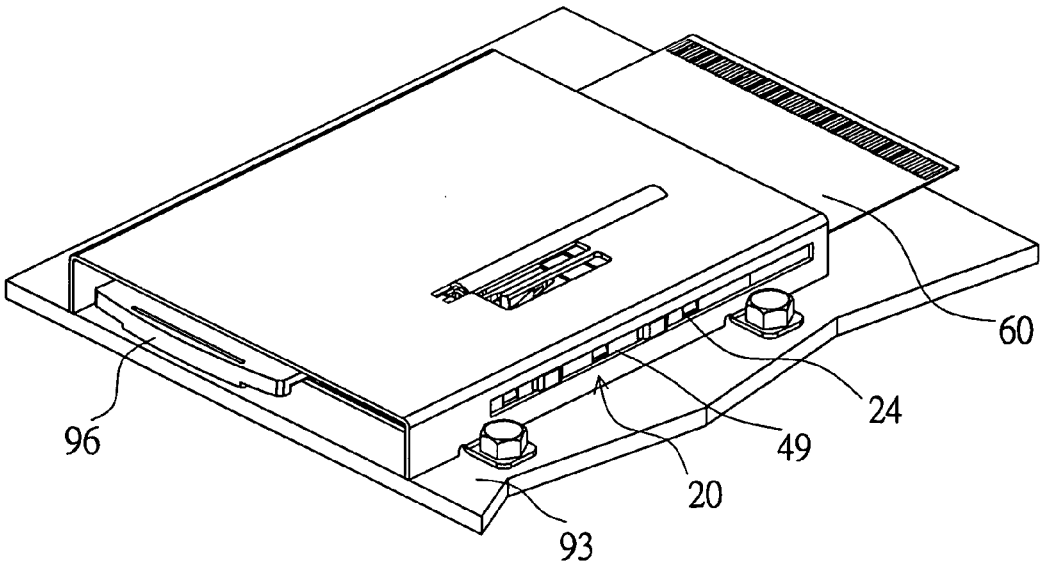
FIG. 11 shows a second usage state when the XDC is inserted into the multi-card connector assembly according to the first embodiment of the invention.

As shown in FIG. 10, when an XDC 96 is inserted into the multi-card connector 40 for electrical connection, the length of the XDC 96 exposed out of the casing 93 substantially equals the first stroke 86. As shown in FIG. 11, the XDC 96 may be pressed inwards. At this time, the multi-card connector 40 slides relative to the mounting seat 20. When an outer edge of the XDC 96 is flush with the casing 93, the XDC 96 together with the multi-card connector 40 move the first stroke 86 and are positioned according to the positioning device.

Figure 12:
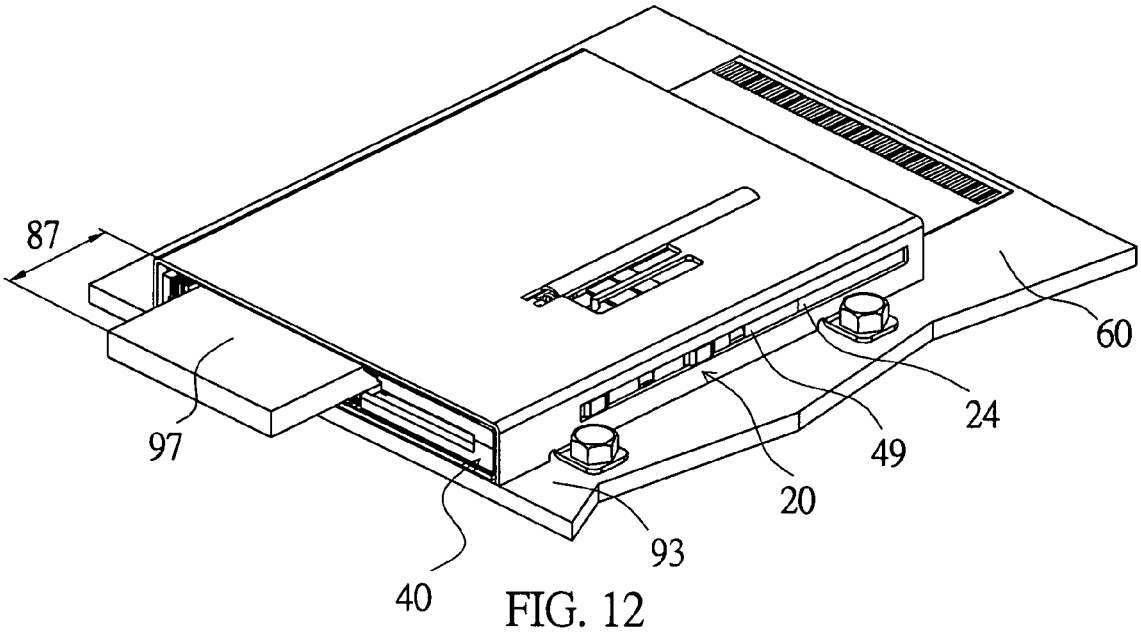
FIG. 12 shows a first usage state when an MSC is inserted into the multi-card connector assembly according to the first embodiment of the invention.
Figure 13:
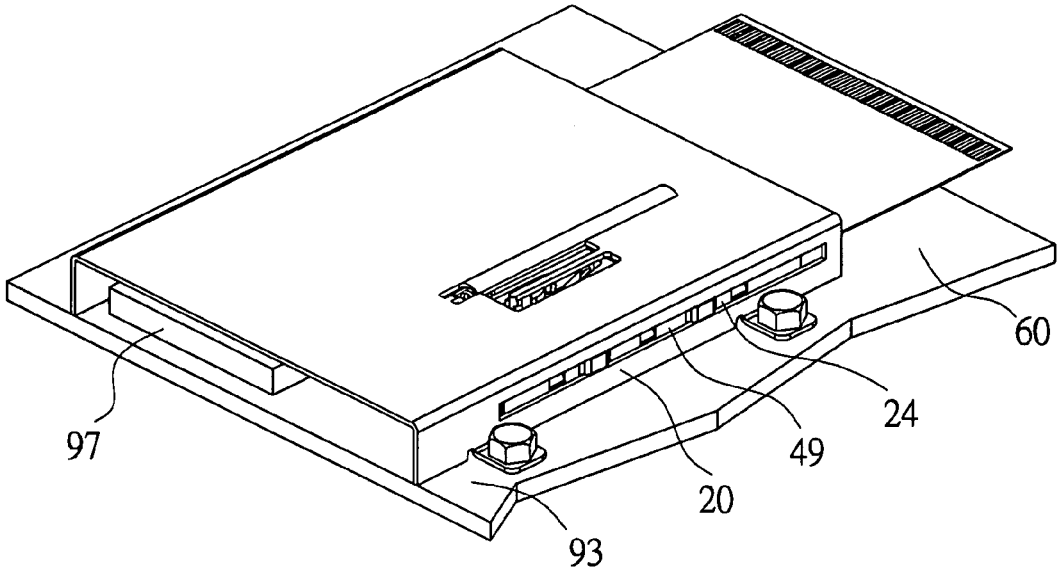
FIG. 13 shows a second usage state when the MSC is inserted into the multi-card connector assembly according to the first embodiment of the invention.

As shown in FIG. 12, when a longer MSC 97 is inserted into the multi-card connector 40 for electrical connection, the length of the MSC 97 exposed out of the casing 93 substantially equals the second stroke 87. The card guiding in/out operation is that the positioning device follows the second stroke of circulation. As shown in FIG. 13, the MSC 97 is pressed inwards. At this time, the MSC 97 together with the multi-card connector 40 slide relative to the mounting seat 20. When the outer edge of the MSC 97 is flush with the casing 93 and the positioning guiding rod 71 of the positioning device is located at the second stroke point 79 (also refer to FIG. 5), the elasticity of the elastic member 65 may cause the second positioning point 80 of the positioning slot 73 to lock the positioning guiding rod 71. Thus, the MSC 97 and the multi-card connector 40 are positioned at the position when the connector slides the second stroke toward the inside of the mounting seat. When the card is to be taken out, the user may press the MSC 97 inwards, and the positioning guiding rod 71 is located at the second stroke card-out starting point 81. When the user lets his/her hand go, the positioning slot 73 slides relative to the positioning guiding rod 71 in the direction of the second sliding passage 82 owing to the action of elasticity. Thus, the positioning guiding rod 71 again returns to the starting point 74, as shown in FIG. 12. At this time, the multi-card connector 40 is ejected, and a length of the MSC 97 is exposed out of the casing 93 so that the MSC 97 may be conveniently removed.

The invention has the following advantages.

1. The feature of the invention is that the multi-card connector 40 can be moved relative to the mounting seat, so the card guiding in/out operations may be achieved when different electrical cards with different dimensions are inserted into the multi-card connector 40.

2. If the lengths of the used electrical cards are substantially the same, only one movable stroke has to be designed in order to achieve the card guiding in/out operations 3. If the length of the used electrical cards are not substantially the same, a plurality of strokes may be easily designed according to the invention in order to achieve the card guiding in/out operations.

4. After the electrical card is inserted into the multi-card connector 40, the card guiding in/out operation is carried out by moving the multi-card connector 40 but not the electrical card. Thus, the rubbing between the electrical card and the contact points of the terminals can be reduced because no reciprocation motion is caused between the card and the terminals. So, the invention can effectively lengthen the lifetime of the connector, and the number of insertions and rejections may be increased.

Figure 14:
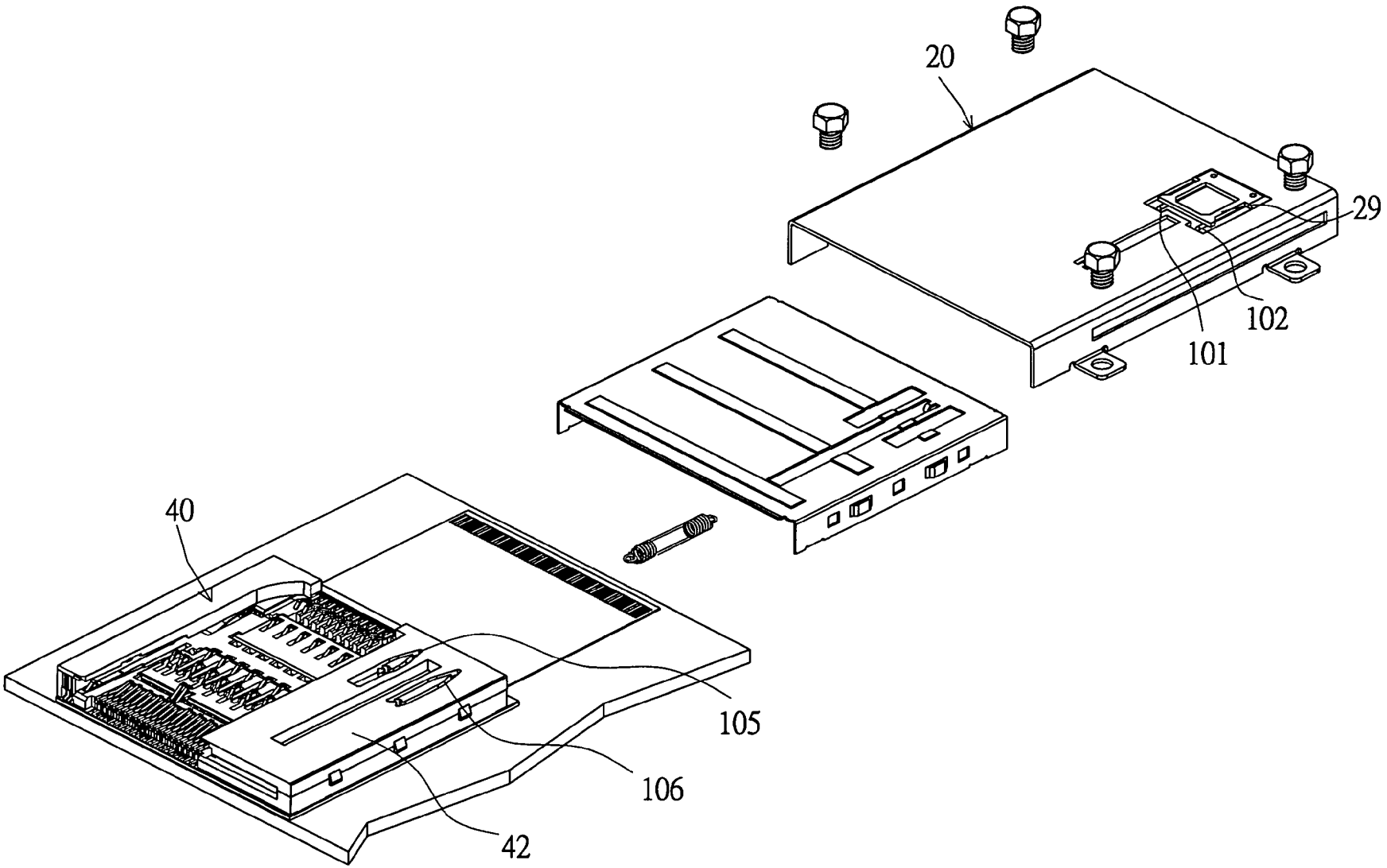
FIG. 14 is a pictorially exploded view showing a multi-card connector assembly according to a second embodiment of the invention.
Figure 15:
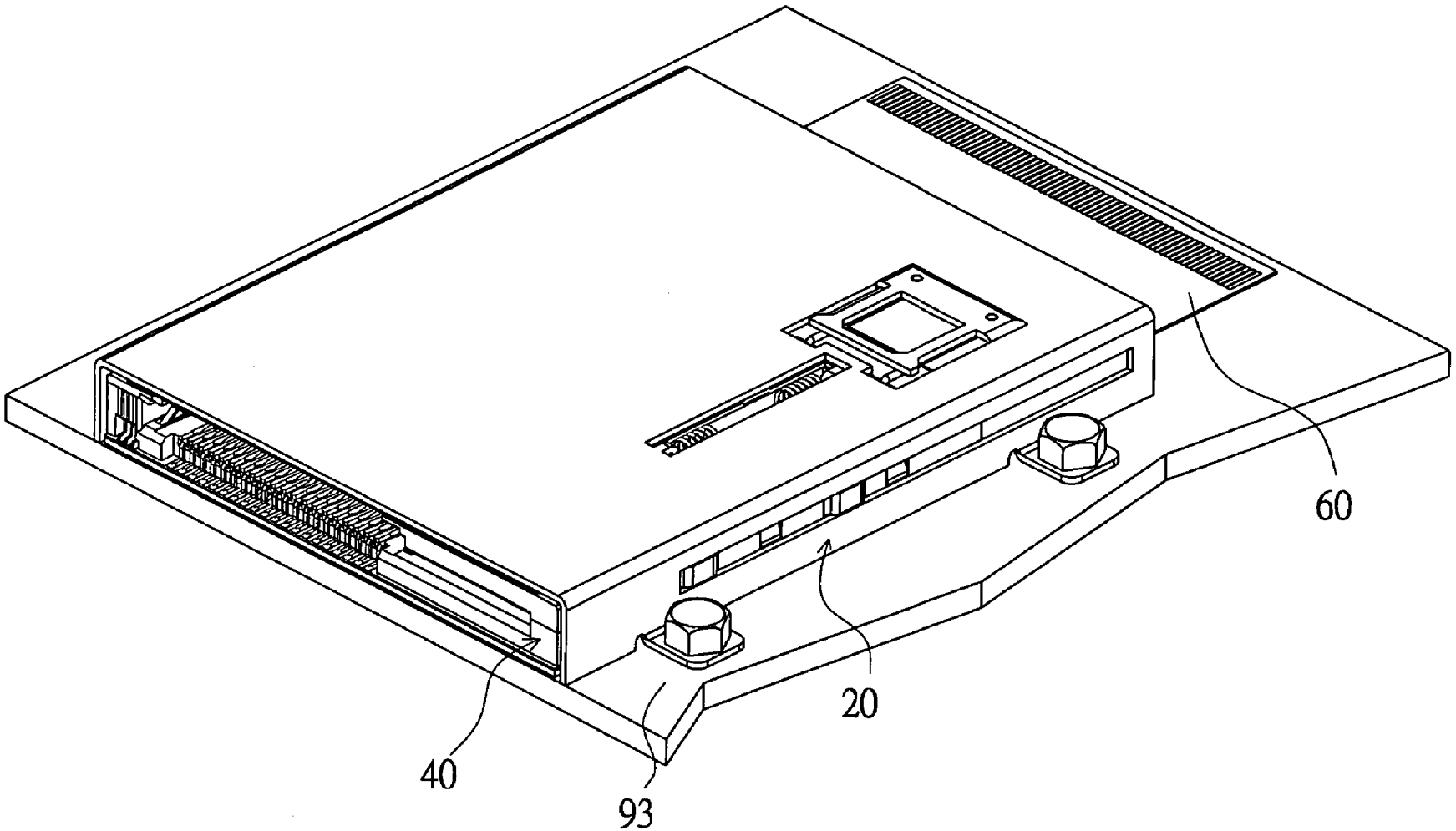
FIG. 15 is a pictorially assembled view showing the multi-card connector assembly according to the second embodiment of the invention.

As shown in FIGS. 14 and 15, the second embodiment of the invention is substantially the same as the first embodiment except the positioning device. The positioning device of the second embodiment includes first and second positioning guiding rods 101 and 102 and first and second positioning slots 105 and 106. The first and second positioning guiding rods 101 and 102 are disposed in parallel. One end of each of the rods 101 and 102 is riveted to an elastic plate 29 formed on the top plate 22 of the mounting seat 20. The elastic plate 29 covers over the first and second positioning guiding rods 101 and 102. The first and second positioning slots 105 and 106, each of which is a one-way sliding passage, are disposed on the middle board 42 of the multi-card connector. The other ends of the first and second positioning guiding rods 101 and 102 are respectively telescoped into the first and second positioning slots 105 and 106.

Figure 16:
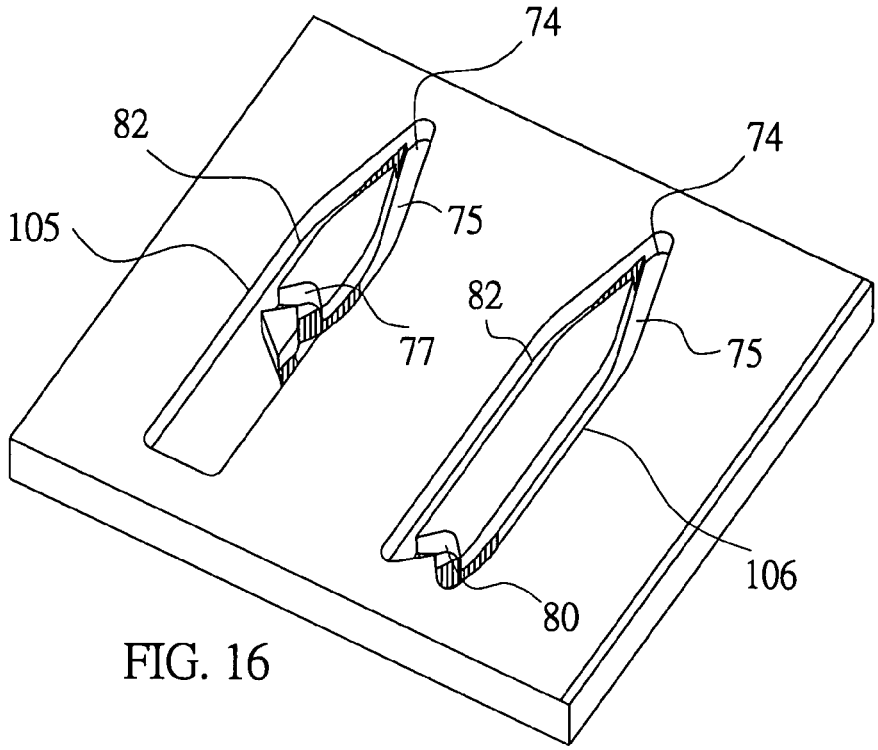
FIG. 16 is a pictorial view showing a positioning slot according to the second embodiment of the invention.
Figure 17:
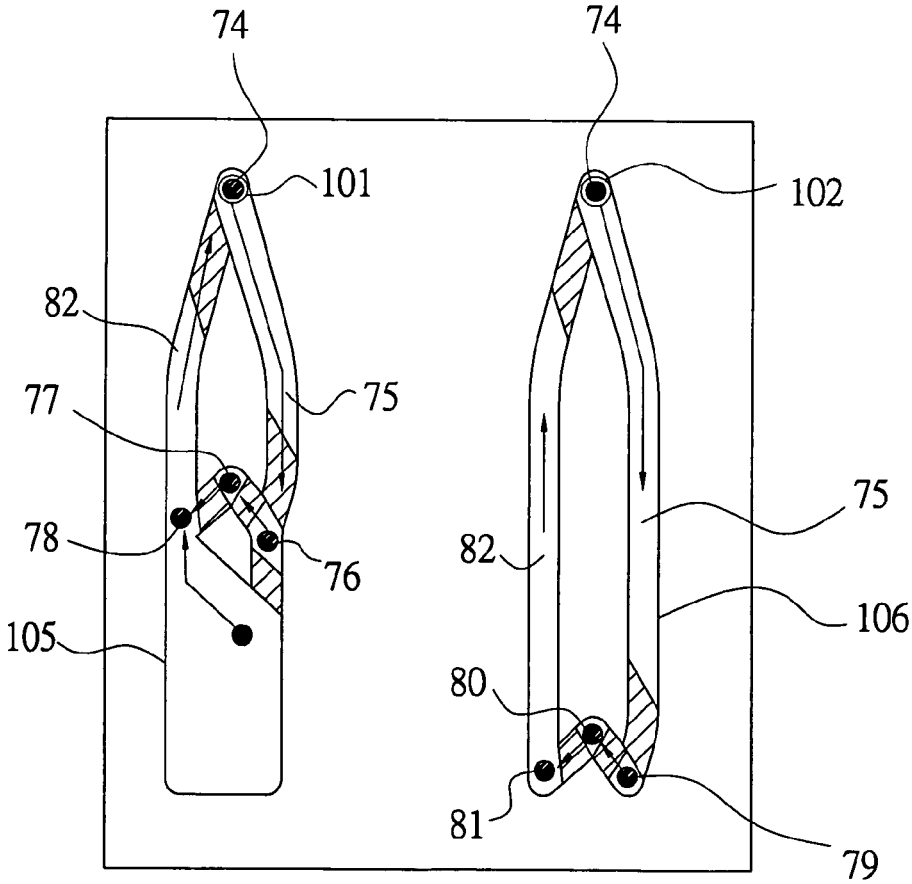
FIG. 17 is a schematic top view showing the positioning slot according to the second embodiment of the invention.

As shown in FIGS. 16 and 17, the first positioning slot 105 guides the first stroke of circulation. The slot 105 has a starting point 74, a first sliding passage 75, a first stroke point 76, a first positioning point 77, a first stroke card-out starting point 78 and a second sliding passage 82. The first stroke circulation starts from the starting point 74 to the first sliding passage 75, the first stroke point 76, the first positioning point 77, the first stroke card-out starting point 78, the second sliding passage 82, and then to the starting point 74. The first positioning guiding rod 101 slides in the first positioning slot 105 and may be positioned at the first positioning point 77 of the starting point 74.

The second positioning slot 106 guides the second stroke of circulation and has a starting point 74, a first sliding passage 75, a second stroke point 79, a second positioning point 80, a second stroke card-out starting point 81 and a second sliding passage 82. The second stroke circulation starts from the starting point 74 to the first sliding passage 75, the second stroke point 79, the second positioning point 80, the second stroke card-out starting point 81, the second sliding passage 82 and then to the starting point 74. The second positioning guiding rod 102 slides in the second positioning slot 106 and may be positioned at the second positioning point 80 of the starting point 74.

Figure 18:
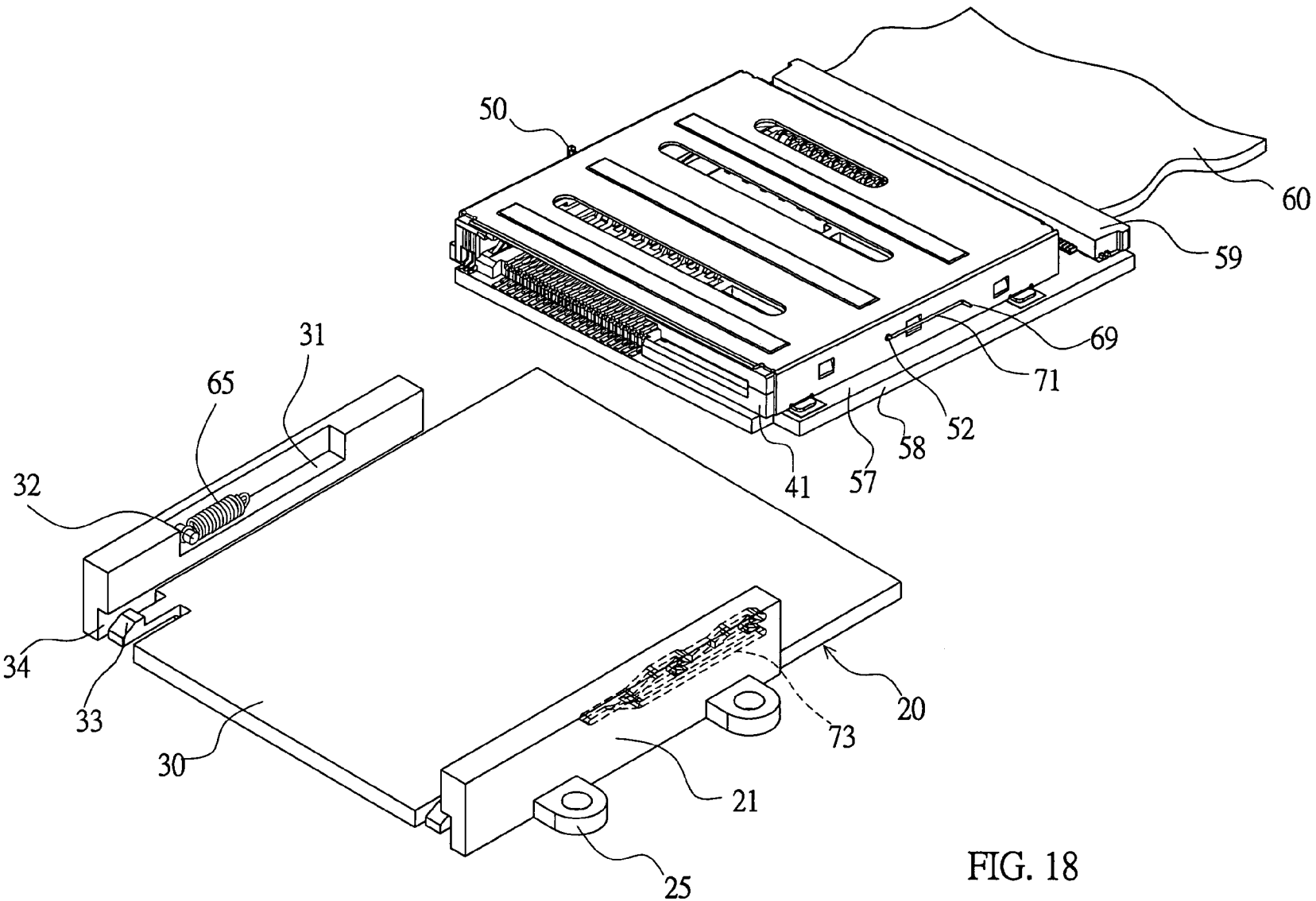
FIG. 18 is a pictorially exploded view showing a multi-card connector assembly according to a third embodiment of the invention.
Figure 19:
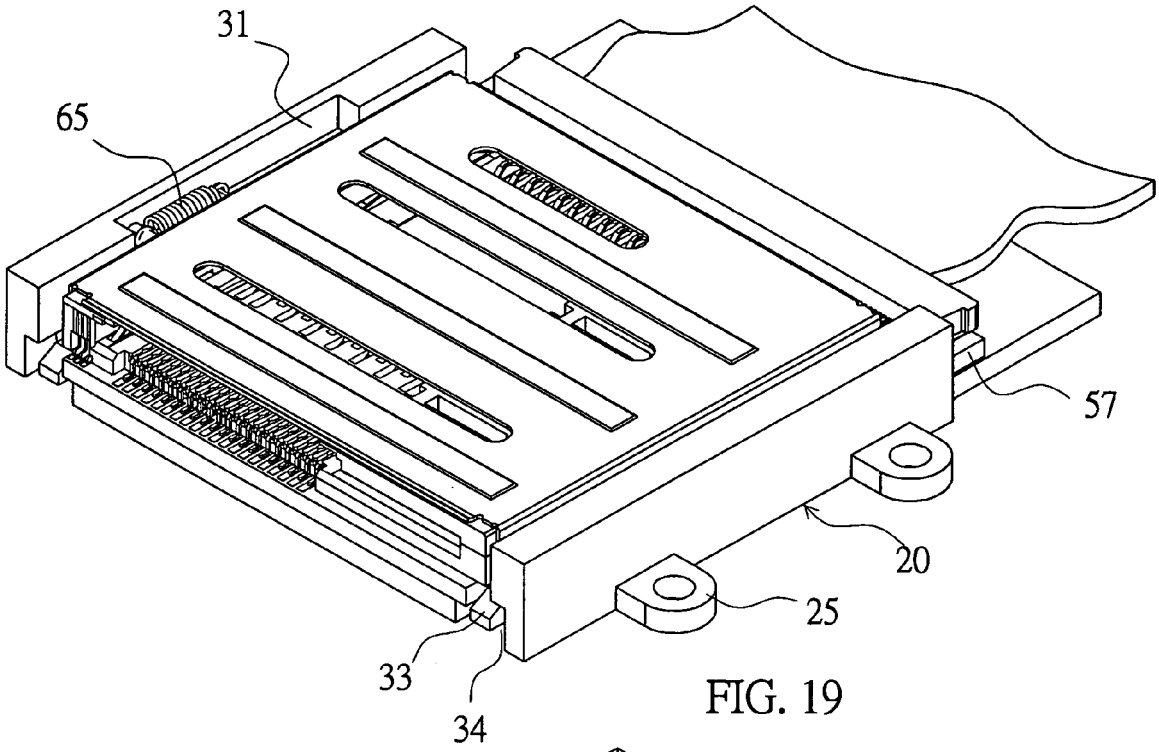
FIG. 19 is a pictorially assembled view showing the multi-card connector assembly according to the third embodiment of the invention.

As shown in FIGS. 18 and 19, the third embodiment of the invention is almost the same as the first embodiment except the following differences.

The mounting seat 20 is U-shaped and has two side plates 21 and a base 30. The sliding region 23 is defined between the two side plates. An inner edge of one of the side plates is formed with a cavity 31. A post 32 is disposed in the cavity 31, and an elastic member 65 is retractable in the cavity 31. Two mounting portions 25 are formed at the lower edge of the side plate. The mounting portion 25 is a positioning hole in this embodiment. A stopper 33 is formed at the front end of the base. The lower edge of the side plate 21 and the base 30 form a slot 34.

Each terminal 55 of the multi-card connector 40 is electrically connected to a printed circuit board 58 having a flexible circuit connector 59. The flexible circuit connector 59 is electrically connected to a flexible circuit connection interface 60, which may be a flexible circuit cable. In addition, the upper cover is formed with a hook 50 at one lateral side, and an engagement hole 52 at the other lateral side. The printed circuit board 58 projects over the base 41 of the multi-card connector 40 at two sides to form flanges 57. When the multi-card connector 40 is sliding in the sliding region 23 of the mounting seat 20, the engagements between the flanges 57 and the slots 34 of the mounting seat 20 cause the connector to slide only in the back and forth direction and to be stopped at the stopper 33.

The elastic member 65 is retractable in the cavity 31 of the mounting seat 20, and has one end fixed to the post 32 in the cavity 31 and the other end fixed to the hook 50 on one side of the multi-card connector 40.

Figure 20:
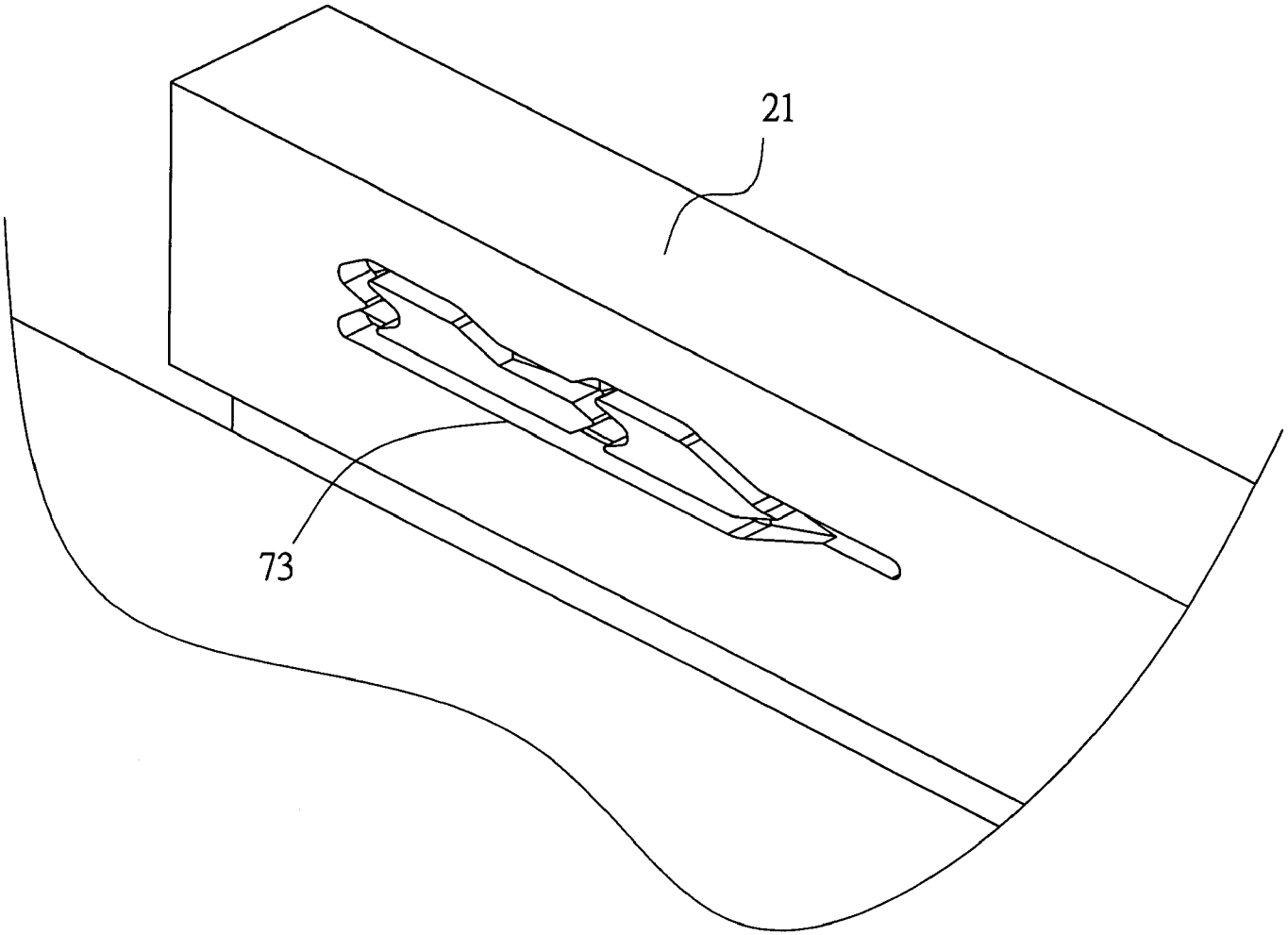
FIG. 20 is a pictorial view showing a positioning slot according to the third embodiment of the invention.

Referring to FIG. 20, the positioning device includes a positioning slot 73 and a positioning guiding rod 71. The positioning slot 73, which is a one-way sliding passage, is formed at an inner edge of a side plate 21 of the mounting seat 20 and extends in the inserting direction of the card. Similar to the first embodiment, this slot 73 has a starting point, a first sliding passage, two strokes of positioning points and a second sliding passage. The slot also forms two strokes of circulating directions, and detailed descriptions thereof will be omitted. The positioning guiding rod 71 has one end fixed to an engagement hole 52 at one side of the multi-card connector 40, and the other end formed with a post 69 sliding in the positioning slot 73. The post 69 may be locked at the starting point and the two positioning points in the positioning slot 73.

Figure 21:
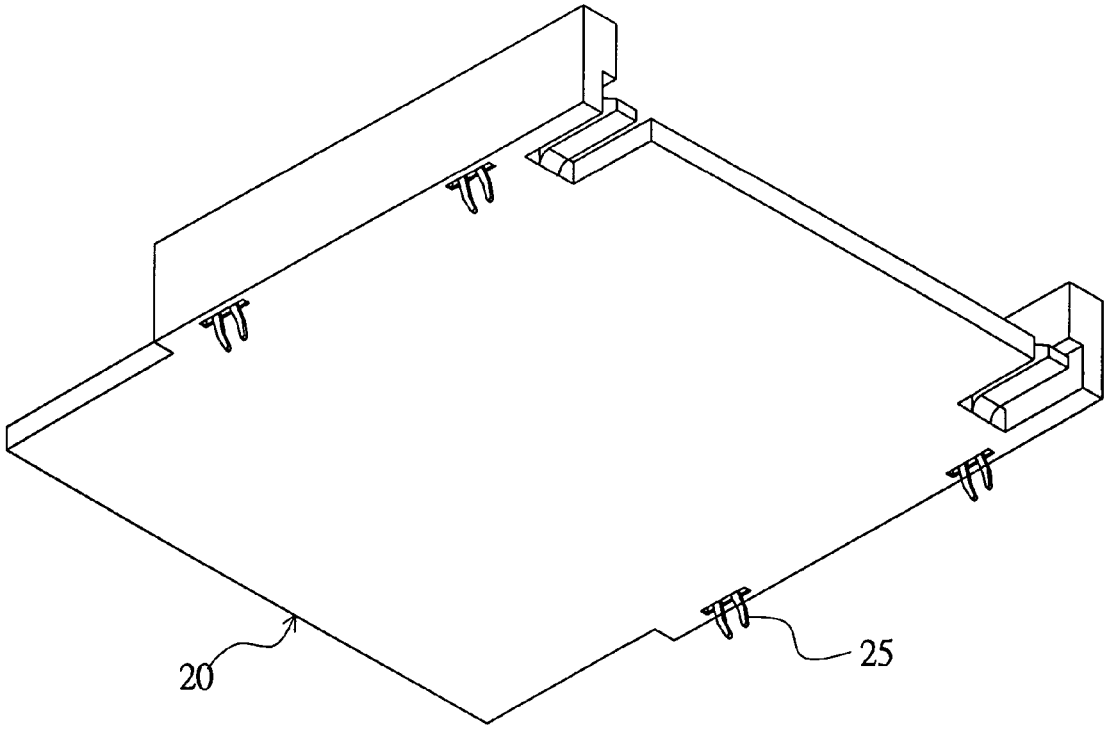
FIG. 21 is a pictorial view showing a mounting seat according to a fourth embodiment of the invention.

As shown in FIG. 21, the mounting portion 25 of the mounting seat 20 in the fourth embodiment of the invention is a hooking member.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A multi-card connector assembly, comprising:

a mounting seat having a sliding region and a mounting portion;

a multi-card connector disposed in the sliding region of the mounting seat, wherein the multi-card connector can be moved only back and forth in the sliding region, the multi-card connector comprises a common seat having a plurality of slots into which different electrical cards may be individually inserted, a plurality of terminals disposed on the common seat, and a flexible circuit connection interface electrically connected to the plurality of terminals, and the flexible circuit connection interface may be connected to an external interface;

an elastic member having one end fixed to the mounting seat and the other end fixed to the multi-card connector; and a positioning device, which is disposed on the mounting seat and the multi-card connector, for positioning the multi-card connector, which slides in the sliding region, at at least one positioning point, wherein the mounting seat is an inverse U-shaped base having two side plates and a top plate, the sliding region is defined between the two side plates, each of the side plates has a sliding slot, and two lateral sides of the multi-card connector are formed with engagement blocks to be engaged with the sliding slots such that the multi-card connector slides in the sliding slot within the sliding region.

2. The assembly according to claim 1, wherein:

the positioning device has a first positioning guiding rod and a second positioning guiding rod on a top surface of the mounting seat;

the positioning device has a first positioning slot and a second positioning slot on the multi-card connector;

the first positioning slot, which is a one-way sliding passage, has a starting point, a first sliding passage, a first stroke of first positioning point and a second sliding passage;

a circulating direction of the first positioning slot starts from the starting point to the first stroke of first positioning point through the first sliding passage, and then from the second sliding passage back to the starting point;

the first positioning guiding rod slides relative to the first positioning slot and may be positioned at the starting point and the first stroke of first positioning point of the first positioning slot;

the second positioning slot is a one-way sliding passage and has a starting point, a first sliding passage, a second stroke of second positioning point and a second sliding passage;

the circulating direction of the second positioning slot starts from the starting point to the second stroke of second positioning point through the fist sliding passage, and then from the second sliding passage back to the starting point; and the second positioning guiding rod slides relative to the second positioning slot and may be positioned at the starting point and the second stroke of second positioning point of the second positioning slot.

3. The assembly according to claim 1, wherein the elastic member is a retractable spring.

4. The assembly according to claim 1, wherein the terminals of the multi-card connector are electrically connected to a flexible printed circuit board, and the flexible printed circuit board is integrally formed with a flexible printed circuit cable.

5. The assembly according to claim 1, wherein the terminals of the multi-card connector are electrically connected to a flexible circuit connector, which is electrically connected to a flexible circuit cable.

6. The assembly according to claim 1, wherein the mounting portion of the mounting seat has a positioning hole.

7. The assembly according to claim 1, wherein the mounting portion of the mounting seat is a hooking member.

8. The assembly according to claim 1, wherein:

the positioning device has a positioning guiding rod on a top surface of the mounting seat, and a positioning slot on the multi-card connector;

the positioning slot is a one-way sliding passage having a starting point, a first sliding passage, at least one stroke of positioning point and a second sliding passage;

a circulating direction of the positioning slot starts from the starting point to the at least one stroke of positioning point through the first sliding passage, and then from the second sliding passage back to the starting point; and the positioning guiding rod slides relative to the positioning slot, and may be positioned at the starting point and the at least one stroke of positioning point in the positioning slot.

9. The assembly according to claim 8, wherein:

the common seat of the multi-card connector includes a base, a middle board covering over the base and formed with a long slot extending in a back and forth direction and the positioning slot of the positioning device, and an upper cover having a top plate and two side plates;

the upper cover covers over the base and the middle board;

the top plate has an opening corresponding to the long slot and the positioning slot of the middle board;

each of the two side plates has the engagement block to be engaged in the sliding slot of the mounting seat; and the elastic member is retractable in the long slot and has one end fixed to the mounting seat and the other end fixed to the upper cover.

10. The assembly according to claim 8, wherein the positioning slot has two strokes of positioning points.

11. The assembly according to claim 10, wherein the first sliding passage has a guiding passage between the two strokes of positioning points to guide the positioning guiding rod toward the second sliding passage.

12. A multi-card connector assembly, comprising:

a mounting seat having a sliding region and a mounting portion;

a multi-card connector disposed in the sliding region of the mounting seat, wherein the multi-card connector can be moved only back and forth in the sliding region, the multi-card connector comprises a common seat having a plurality of slots into which different electrical cards may be individually inserted, a plurality of terminals disposed on the common seat, and a flexible circuit connection interface electrically connected to the plurality of terminals, and the flexible circuit connection interface may be connected to an external interface;

an elastic member having one end fixed to the mounting seat and the other end fixed to the multi-card connector; and a positioning device, which is disposed on the mounting seat and the multi-card connector, for positioning the multi-card connector, which slides in the sliding region, at at least one positioning point, wherein:

the mounting seat having a U-shape has two side plates and a base, and the sliding region is defined between the two side plates;

the positioning device has a positioning slot and a positioning guiding rod;

the positioning slot is formed at an inner edge of one of the side plates of the mounting seat and extends in a back and forth direction;

the positioning slot is a one-way sliding passage and has a starting point, a first sliding passage, at least one stroke of positioning point and a second sliding passage;

a circulating direction of the positioning slot starts from the starting point to the at least one stroke of positioning point through the first sliding passage, and then starts from the second sliding passage back to the starting point;

the positioning guiding rod has one end fixed to a side of the multi-card connector, and the other end formed with a post sliding in the positioning slot; and the post can be positioned at the starting point and the at least one stroke of positioning point of the positioning slot.

13. The assembly according to claim 12, wherein the positioning slot has two strokes of positioning points.

* * * * *